US008517347B2

(12) United States Patent
Forster

(10) Patent No.: US 8,517,347 B2
(45) Date of Patent: Aug. 27, 2013

(54) DRUM WINCH

(75) Inventor: Dean Robert Forster, Hallet Cove (AU)

(73) Assignee: Stress Free Marine Pty Ltd., Lonsdale (AU)

( * ) Notice: Subject to any disclaimer, the term of this patent is extended or adjusted under 35 U.S.C. 154(b) by 443 days.

(21) Appl. No.: 12/741,584

(22) PCT Filed: Nov. 12, 2008

(86) PCT No.: PCT/AU2008/001669
§ 371 (c)(1),
(2), (4) Date: May 5, 2010

(87) PCT Pub. No.: WO2009/062232
PCT Pub. Date: May 22, 2009

(65) Prior Publication Data

US 2010/0258773 A1 Oct. 14, 2010

(30) Foreign Application Priority Data

Nov. 15, 2007 (AU) ..... 2007906255

(51) Int. Cl.
*B66D 1/14* (2006.01)

(52) U.S. Cl.
USPC ..... 254/346; 254/317; 254/330

(58) Field of Classification Search
USPC ..... 254/278, 317, 330, 331, 346, 351, 254/370
See application file for complete search history.

(56) References Cited

U.S. PATENT DOCUMENTS

| | | | | |
|---|---|---|---|---|
| 338,929 | A | 3/1886 | Champlin | |
| 715,991 | A | 12/1902 | Covell | |
| 780,159 | A | 1/1905 | Corbett | |
| 2,278,022 | A * | 3/1942 | Rodgers | 254/330 |
| 2,464,907 | A * | 3/1949 | Unruh | 192/66.23 |
| 3,744,760 | A * | 7/1973 | Uher | 254/351 |
| 3,817,494 | A * | 6/1974 | Eckerdt | 254/330 |

(Continued)

FOREIGN PATENT DOCUMENTS

| | | | |
|---|---|---|---|
| CA | 974971 | A | 9/1975 |
| GB | 943594 | A | 12/1963 |
| GB | 948592 | A | 2/1964 |

OTHER PUBLICATIONS

Extended and Supplementary Search Report dated Jan. 31, 2013 for International Application No. PCT/AU2008001669, filed Nov. 12, 2008.

*Primary Examiner* — Emmanuel M Marcelo
(74) *Attorney, Agent, or Firm* — Knobbe, Martens, Olson & Bear LLP

(57) ABSTRACT

The invention relates to a drum winch (100) that is arranged to allow "free fall" of an anchor secured by rode to a drum (116) of the drum winch (100). The drum winch (100) includes a mounting bracket (112) and a drive shaft (114) arranged to be mounted to the mounting bracket (112) and coupled to the drive unit (118). The drum (116) is arranged relative to the drive shaft (1114) so that in a first mode of operation of the drum winch (100), the drum (116) can be rotated by rotation of the drive shaft (114). In a second mode of operation of the drum winch (100), the drum (116) is free to rotate relative to the drive shaft (114) so as to enable "free fall" of the anchor. The drum winch (100) further includes means for actuating (150) either the first mode of operation or the second mode of operation.

20 Claims, 4 Drawing Sheets

(56) References Cited

U.S. PATENT DOCUMENTS 4,087,060 A * 5/1978 Laky et al. ..... 242/399.1
4,497,470 A * 2/1985 Carter et al. ..... 254/134.3 FT
4,683,994 A * 8/1987 Weisenfelder ..... 192/3.61
5,238,200 A * 8/1993 Ritzenthaler ..... 242/390.1
5,678,805 A * 10/1997 Moser et al. ..... 254/279
7,891,641 B1 * 2/2011 Miller ..... 254/346

* cited by examiner

DRUM WINCH

CROSS REFERENCE

This application claims priority from Australian Provisional Patent Application No. 2007906255 filed on 15 Nov. 2007, the contents of which are to be taken as incorporated herein by this reference.

FIELD OF THE INVENTION

The present invention relates to an improved drum winch. The drum winch has particular, but not exclusive, application in marine vessels as an anchor drum winch.

BACKGROUND OF THE INVENTION

Some marine vessels use a powered anchor drum winch to lower and then retrieve their anchor. The anchor is secured to the vessel by the rode. The rode may consist of all chain, all rope, or a combination of rope and chain. Such anchor drum winches are typically mounted in the vessel's anchor well. The rode is wound onto the drum of the winch avoiding the necessity to store the rode in the anchor well. This prevents tangling of the rode, negates the need to tie off the anchor rode and makes lowering and retrieval of the anchor very easy.

A disadvantage of such powered anchor drum winches is the inability to allow the anchor to free fall. The present invention seeks to address this disadvantage.

The discussion of the background to the invention herein is included to explain the context of the invention. This is not to be taken as an admission that any of the material referred to was published, known or part of the common general knowledge as at the priority date of this application.

SUMMARY OF THE INVENTION

According to a first aspect of the present invention there is provided a drum winch including a mounting bracket, a drive shaft arranged to be mounted to the mounting bracket and further arranged for coupling to a drive unit, the drum winch further including a drum on which rode can be wound, the drum being arranged relative to the drive shaft so that in a first mode of operation of the winch the drum can be rotated by rotation of the drive shaft and in a second mode of operation of the winch the drum is free to rotate relative to the drive shaft and wherein the drum winch further includes means for actuating either the first mode of operation or the second mode of operation.

The invention provides a drum winch wherein the drum has a capability in one mode of operation to freely rotate relative to the drive shaft so that when tension is applied to the end of the rode, such as would occur if an anchor attached to the rode was released overboard, the drum can freely rotate to release the rode until the anchor hits the ocean bottom. In another mode of operation, the drum is rotated only by the drive of the drive shaft.

The means for actuating either the first or second mode of operation includes means for moving either the drum and/or the drive shaft between a first and a second position.

In one preferred embodiment, the moving means moves only the drum between the first and the second positions. In such an embodiment, the drum is translated in a direction parallel to a longitudinal axis of the drive shaft and more preferably coincident to the longitudinal axis of the drive shaft.

Rotational drive of the drum when in the first position is achieved by coupling the drum to the drive shaft so that rotational movement of the drive shaft is directly transmitted to the drum thereby causing rotational movement of the drum. In the second position, the drum is de-coupled from the drive shaft so that rotational movement of the drive shaft is not transmitted to the drum. Furthermore, in the second position, the drum is arranged to enable free rotation thereof about the drive shaft.

Drive coupling of the drum to the drive shaft is achieved in accordance with one embodiment of the invention by means of a coupling section of the drive shaft and a complementary socket on the drum. When the coupling section of the drive shaft is located within the socket, rotational movement of the shaft is transmitted to the drum. It will of course be appreciated that the reverse arrangement of socket and coupling section (i.e. socket on the drive shaft and coupling section on the drum) is envisaged.

Movement of the drum from the first to the second position is preferably achieved by way of an actuator that is arranged to apply a force to the drum so that the coupling section of the shaft is no longer located within the socket of the drum. The force applied by the actuator to the drum preferably translates the drum along the drive shaft. A return means, preferably in the form of a spring arrangement, is provided to return the drum to the first position when the actuator is deactivated.

It is envisaged that it would be advantageous to include some means for preventing or at least reducing continued free rotation (i.e. overrun) of the drum when the anchor hits the ocean bottom. To this end some means for 'braking' the drum may be included. In one embodiment such a 'brake' is provided by a bush located between the spring arrangement and outer end of the drum that serves to at least slow continued rotation of the drum. Another bush is preferably located at the inner end of the drum.

According to a second aspect of the present invention there is provided a free fall adaptor assembly for a drum winch, the assembly including a drive shaft for mounting a drum, an actuator arranged to move the drum from a first position in which the drum is rotated by drive of the drive shaft to a second position wherein the drum is free to rotate relative to the drive shaft and a return means for returning the drum to the second position.

The adaptor assembly preferably further includes a lever having a first end arranged to be fixed to a mounting bracket of the drum winch or another support means and a second end arranged to cantilever about said first end when pressed against by said actuator.

A free fall adaptor assembly in accordance with an embodiment of the invention is arranged to be retrofitted to an existing drum winch so as to enable, with some other modifications, the conversion of a conventional drum winch to a drum winch with free fall capability.

DESCRIPTION OF THE DRAWINGS

Embodiments of the invention will now be described, by way of example only, with reference to the accompanying drawings in which.

DETAILED DESCRIPTION OF PREFERRED EMBODIMENTS

Figure 1:
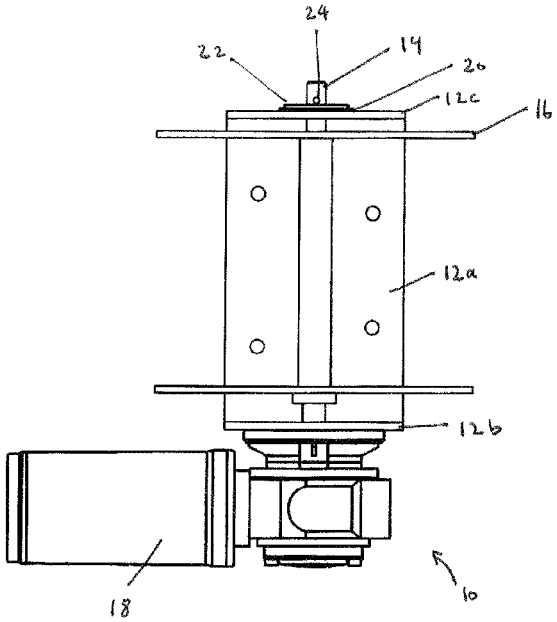
FIG. 1 is a plan view of a prior art drum winch.
Figure 2:
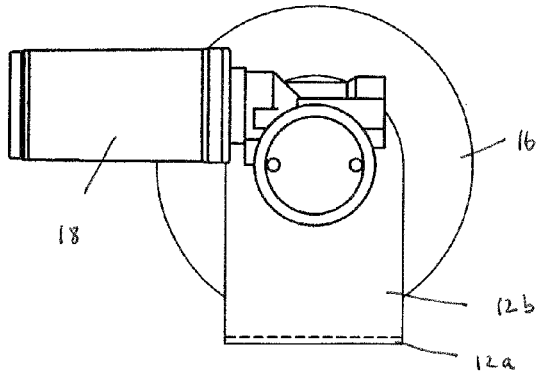
FIG. 2 is an end view of the prior art drum winch shown in FIG. 1.

FIGS. 1 and 2 illustrate a prior art drum winch 10 for a marine vessel (not shown) that is used to lower and raise the vessel's anchor. The drum winch 10 includes a one piece mounting bracket (including a base plate 12*a*, an inner upright 12*b* and an outer upright 12*c*), a drive shaft 14, a drum 16 on which rode can be wound and a drive unit 18. Fasteners (not shown) extending through the base plate 12*a* of the mounting bracket 12 are used to securely mount the anchor drum winch 10 in the vessel's anchor well.

The drum 16 is in the form of a reel having a cylindrical hollow core. The drive shaft 14 extends through the core of the drum 16 and through a pair of bushes (not visible). The bushes mount the drum 16 on the drive shaft in such a manner as to ensure that the drum 16 only rotates with the drive shaft 14. Hence, when the drive shaft 14 is held stationary by the drive of the drive unit 18, the drum 16 is also prevented from rotating.

One end of the drive shaft 14 is coupled to the drive unit 18 that is mounted on the inner upright 12*b* of the mounting bracket 12. The other end of the drive shaft 14 extends through a bearing 20 located in the outer upright 12*c*. A washer 22 and pin 24 prevent axial movement of the drive shaft 14.

The drive shaft 14 is coupled to the drive unit 18 so that the drive shaft 14 is rotated in either a clockwise or anticlockwise direction upon activation of the drive unit 18. This enables the rode wound on the drum 16 to be either unwound from the drum 16 (i.e. when lowering the anchor) or wound onto the drum 16 (when retrieving the anchor) by selective activation of the drive unit 18 by an operator. It will be appreciated that in this prior art arrangement, the drum 16 and drive shaft 14 are mounted together in such a manner that it is not possible for the drum 16 to rotate independently of the drive shaft 14. Hence, free fall release of the rode via free rotation of the drum 16 relative to the drive shaft 14 is not possible.

Figure 3:
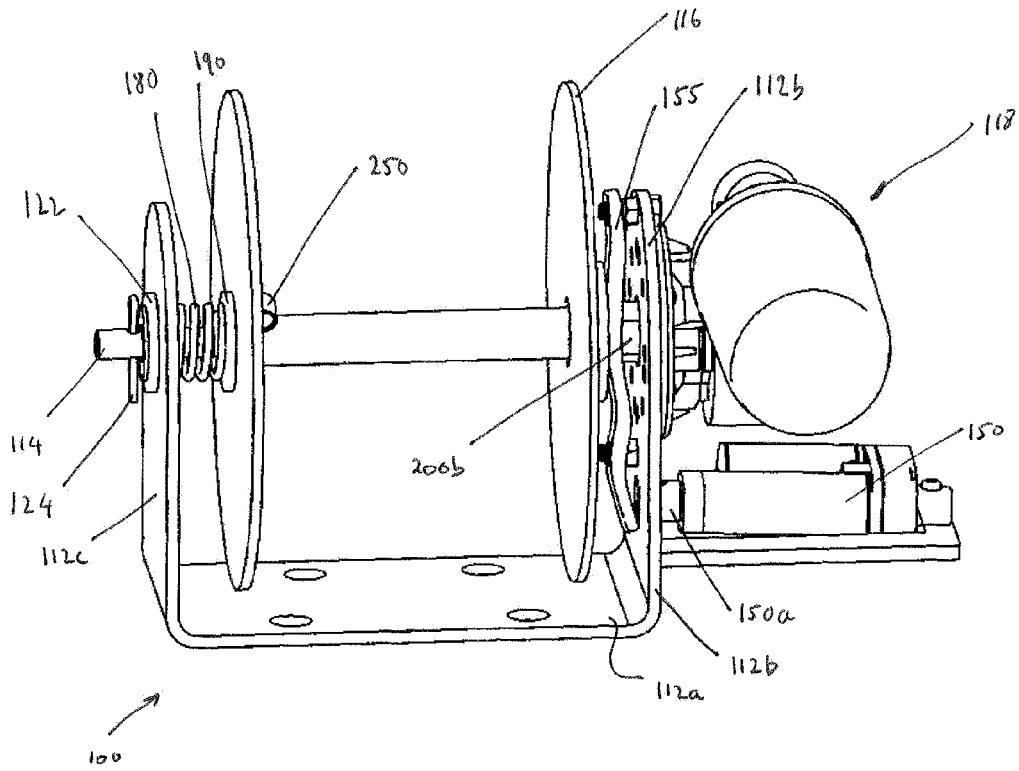
FIG. 3 is a side perspective view of a drum winch in accordance with an embodiment of the present invention. The drum winch is shown in the "drive" mode.

FIG. 3 illustrates a drum winch 100 in accordance with an embodiment of the invention. The anchor drum winch 100 is similar to the winch 10 described above in that it includes a mounting bracket 112, a drive shaft 114, a drum 116 on which rode can be wound and a drive unit 118. However, unlike the prior art anchor drum winch 10 described above, the anchor drum winch 100 has the capability, in one mode of operation, to enable the drum 116 to freely rotate relative to the drive shaft 114. This means that in this "free" mode of operation, tension applied to a free end of the rode attached to the drum 116 will cause the drum 116 to rotate and thereby unwind rode from the drum 116. Accordingly, the anchor drum winch 100 can be operated to enable free fall of the anchor (not shown). This free fall capability is achieved by selectively decoupling the drive of the drive shaft 114 from the drum 116. A preferred method of achieving this decoupling will become apparent from the following description.

Figure 8A:
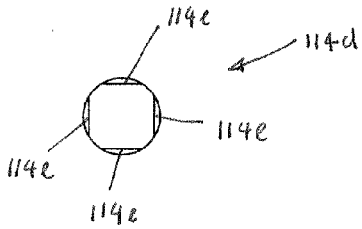
FIG. 8*a* is an enlarged cross-sectional view of the drive shaft at the coupling section as shown in FIG. 8.
Figure 6:
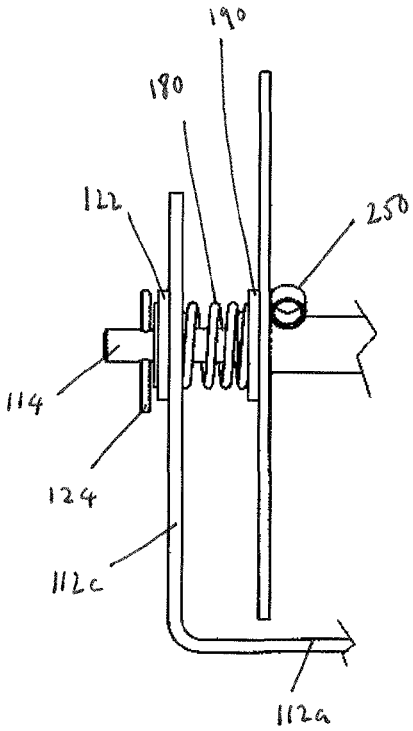
FIG. 6 is a close up view of an outer end of the winch shown in FIG. 3. The anchor drum winch is in the "drive" mode.
Figure 8:
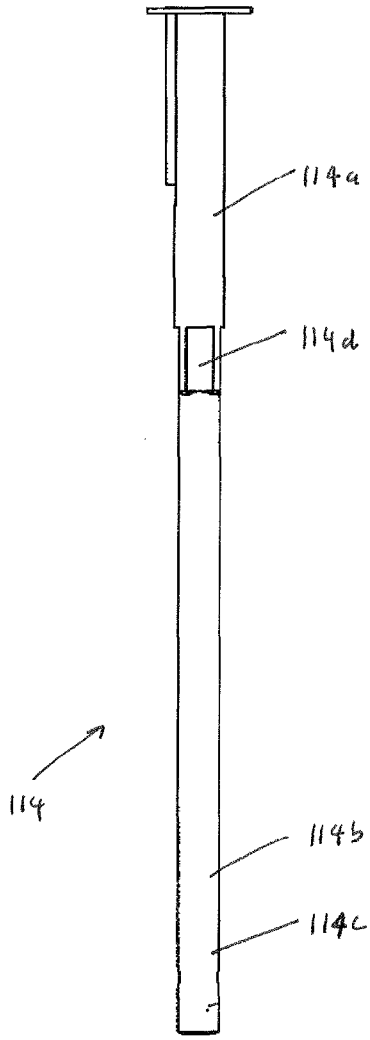
FIG. 8 is a plan view of the drive shaft of the anchor drum winch shown in FIG. 3.

FIG. 8 illustrates the drive shaft 114 in more detail. The drive shaft 114 includes a larger diameter section 114*a* and a smaller diameter section 114*b*. The larger diameter section 114*b* is arranged in use to engage with the drive unit 118 so that the drive unit 118 can rotate the drive shaft 114. The smaller diameter section 114*b* is arranged to extend through the core of the drum 116 and bushes (not visible) that mount the drum 116, so that the drum 116 is free to rotate about the shaft 114 when the winch is in the "free" mode of operation. An outer end portion 114*c* of the drive shaft 114 is housed within a bearing (not visible) located in the outer upright 112*c*. As best shown in FIG. 6, a washer 122 and pin 124 prevent axial movement of the shaft 114 in the assembled anchor winch 100.

Between the larger diameter section 114*a* and smaller diameter section 114*b* of the drive shaft 114 there is a coupling section 114*d*. As best shown in FIG. 8*a*, the coupling section 114*d* of this embodiment has four flat faces 114*e* cut into the circumference of the shaft 114. FIG. 8*a* illustrates the cross-section of the shaft 114 at the coupling section 114*d*.

Figure 4A:
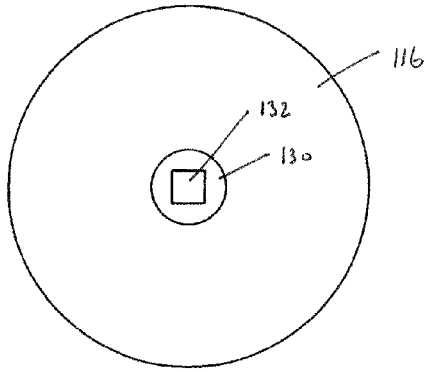
FIG. 4*a* is an end view (not to scale) of the inner end of the drum showing the drum boss and socket. The bush over the drum boss is not depicted in this view.
Figure 4:
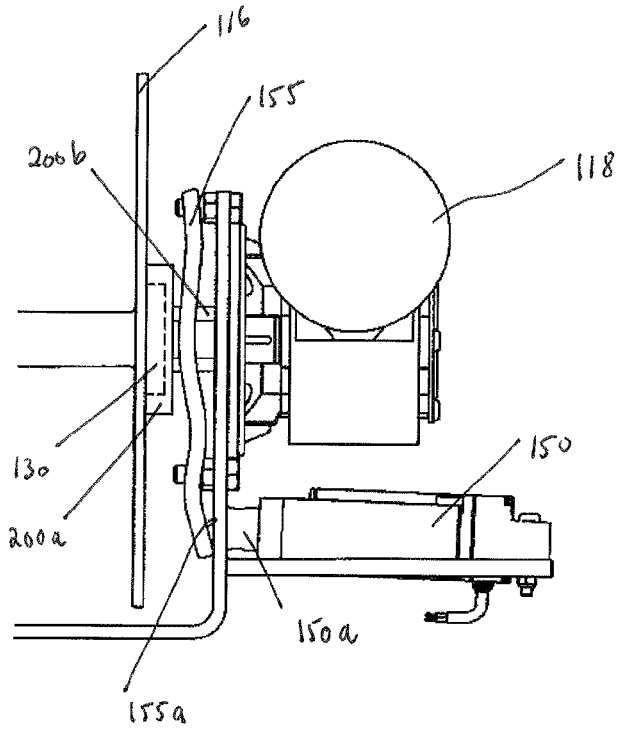
FIG. 4 is a close up view of a first or inner end of the drum winch shown in FIG. 3. The actuator of the winch is shown in the "drive" mode.
Figure 5:
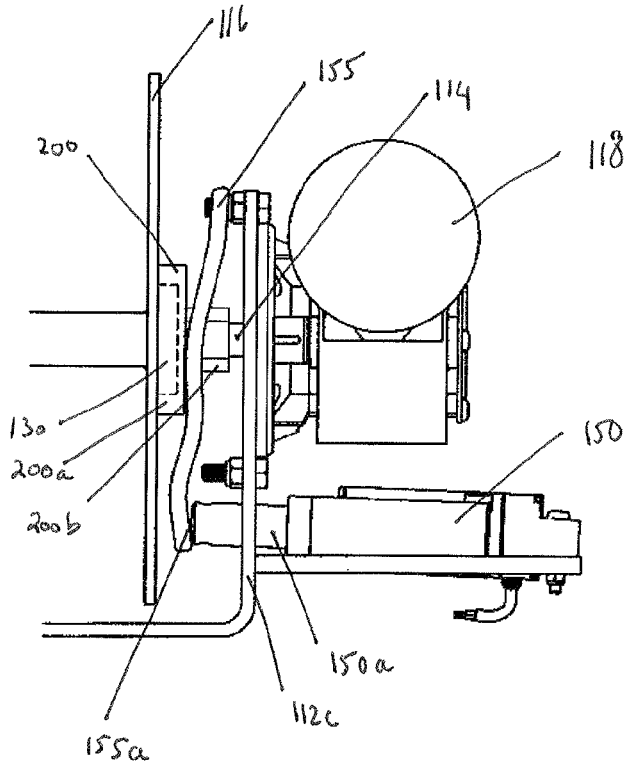
FIG. 5 is another close up view of the first or inner end of the drum winch shown in FIG. 3. The actuator of the winch is shown in the "free fall" or "free" mode.

As shown in FIGS. 4, 4*a* and 5, a first or inner end of the drum 116 adjacent the drive unit 118 has a drum boss 130 attached thereto. The drum boss 130 includes a socket 132 of a size and shape complementary to the coupling section 114*d* of the drive shaft 114. When the coupling section 114*d* of the drive shaft 114 is located within the socket 132 any rotation of the drive shaft 114 is directly transmitted to the drum 116 causing the drum 116 to rotate.

In accordance with this embodiment, the socket 132 of the drum boss 130 has a square shaped opening complementary to the four flat faces 114*e* of the coupling section 114*d* of the drive shaft 114. It will thus be appreciated that when the coupling section 114*d* of the drive shaft 114 is engaged within the socket 132 of the drum boss 130 and then the drive unit 118 is activated to rotate the drive shaft 114, the engagement between the faces 114*e* of the coupling section 114*d* and the internal wall of the socket 132 will also cause the drum 116 to be rotated. Similarly, if the coupling section 114*d* of the drive shaft 114 is not engaged within the socket 132 of the drum boss 130, activation of the drive unit 118 will cause rotation of the drive shaft 114 but will not cause rotational drive of the drum 116. Furthermore, when the coupling section 114*d* of the drive shaft 114 is not engaged within the socket 132 of the drum boss 130 the drum 116 is free to rotate about the drive shaft 114. Hence, if tension was applied to the rode wound on the drum 116, as would happen if the vessel's anchor was discharged, the drum 116 would be free to rotate. Thus, free fall of the anchor would occur.

As best shown in FIGS. 4 and 5, the drum winch 100 is further provided with an actuator 150 and a lever hereafter referred to as a translation plate 155. The translation plate 155 is formed from a piece of metal plate that is mounted cantilever style to the upright 112*b*. The free end of the translation plate is located between the drum and the inner upright 112*b* of the mounting bracket 112. The translation plate 155 includes an aperture which is located and sized to enable the drive shaft 114 to pass there through. As explained below, the translation plate 155 has a side face 155*a* arranged for selective engagement with the actuator 150.

When the actuator 150 is activated by the operator, the arm 150*a* of the actuator 150 is driven outwardly so as to contact and push against the side face 155*a* of the translation plate 155. As the arm 150*a* continues to extend, the free end of the translation plate 155 is cantilevered away from the upright 112*c* and a part of the translation plate 155 moves into contact with a bush 200 located over the drum boss 130. Continued extension of the arm 150*a* pushes or translates the bush 200, the drum boss 130 and the attached drum 116 along the drive shaft 114 in a direction away from the upright 112*c*, thus moving the drum 116 from a first position to a second position. Translation of the drum boss 130 and attached drum 116 along the drive shaft 116 disengages the socket 132 of the drum boss 130 from the coupling section 114*d* of the drive shaft 114. Hence the drum 116 in the second position is no longer coupled to the coupling section 114*d* of the drive shaft 114. The drum 116 is therefore free to rotate about the smaller diameter section 114*b* of the drive shaft 114 when in the second position. This is the "free" mode of operation of the drum winch 100.

Figure 7:
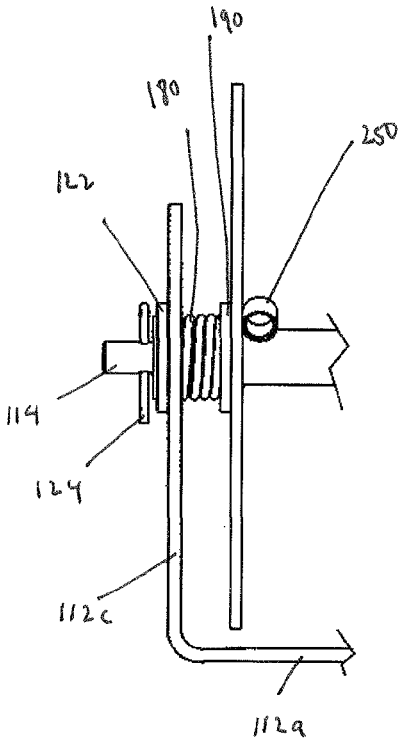
FIG. 7 is another close up view of the outer end of the winch shown in FIG. 3. The anchor drum winch is in the "free" mode.

When the actuator 160 is deactivated by the operator, the arm 160 is retracted back into the actuator 160. A return means in the form of a biasing means (spring 180) is provided to return the drum 116 from the second position to the first position. As shown in FIGS. 6 and 7, the spring 180 is located between the upright 112*b* and a second or distal end of the drum 116. The spring 180 biases the drum 116 towards a position wherein the coupling section 114*d* is engaged within the socket 132 of the drum boss 130. In other words, the spring 180 biases the drum 116 from the second position back to the first position. This is the "drive" mode of the drum winch 100.

In this particular embodiment, a bush 190 is provided between the spring 180 and outer end of the drum 116. The bush 190 acts as a 'brake' to help prevent overrun of the drum 116 (i.e. the continued rotation of the drum 116 to release rode) when the anchor hits the ocean floor by slowing rotation of the drum 116. In addition, the bush 190 reduces wear between the spring 180 and the outer end of the drum 116 due to rotation of the drum 116 and reduces any resultant noise.

The bush 200 that overlays the drum boss 130 also acts as a 'brake' to help prevent overrun of the drum 116 (i.e. the continued rotation of the drum 116 to release rode) when the anchor hits the ocean floor. In addition, the bush 200 reduces wear of the drum boss 130 due to repeated contact with the translation plate 155.

As illustrated, by way of example, the bush 200 includes a first portion 200*a* and a second portion 200*b* of reduced diameter. The first portion 200*a* is shaped to extend over the boss 130 and sit flush against the end plate of the inner end of the drum 116. The second portion 200*b* extends over a portion of the drive shaft 114.

In accordance with the illustrated preferred embodiment, a short piece of metal tubing 250 is welded to the centre tube of the drum 116 adjacent the distal end of the drum 116. The tubing 250 provides a fastening point to which the end of the rode on the drum 116 can be attached.

From the above description it will be apparent that the drum winch 100 has two different modes of operation. A first mode of operation is a "drive" mode which occurs when the coupling section 114*d* is in engagement with the socket 132 of the drum boss 130 and hence rotation of the drive shaft 114 upon activation of the drive unit 118 results in rotational drive of the drum 116. This rotational drive may be in a clock-wise or anti-clockwise direction to enable rode on the drum 116 to be wound or unwound from the drum 116 by operator controlled drive of the drive shaft 114.

In a second mode of operation (the "free fall" or "free" mode), the actuator 160 is activated to translate the drum 116 along the drive shaft 114 to the second position. In this second position, the coupling section 114*d* of the drive shaft 114 is not in engagement with the socket 132 of the drum boss 130. Hence rotation of the drive shaft 114 upon activation of the drive unit 118 does not result in rotational drive of the drum 116. When the drum winch 100 is in this "free fall" mode, the drum 116 is free to rotate independently of the drive shaft 114 and hence free fall of an anchor attached to the rode can occur.

It will be appreciated that the drive unit 118 may adopt any suitable form and that the exact nature of the drive unit is not consequential to the present invention. It should also be appreciated that the nature of the bearings or bushes used to mount the drive shaft relative to the mounting bracket and/or drum may vary and that many variations or equivalents are envisaged.

It will be appreciated that the prior art anchor drum winches such as that shown in FIGS. 1 and 2 may be converted to enable them to have a "free" mode. Various modification would need to be made to such prior art drum winches including the attachment of a free fall adaptor assembly. The free fall adaptor assembly includes a drive shaft 116, a lever (translation plate 155), an actuator 150 and a return spring 180. Although various changes may need to be made to the bearings or bushes attaching the drum 16 to the drive shaft 14, the more expensive components of the drum winch 10 such as the drive unit 18 can be maintained.

It will also be appreciated that operation of the actuator 150 may be controlled from a location remote to the drum winch 100. Typically, operational control of a drum winch in accordance with an embodiment of the invention would be provided in such a way to enable the driver of the vessel to control the drum winch.

The embodiments have been described by way of example only and modifications within the spirit and scope of the invention are envisaged.

The invention claimed is:

1. A drum winch including a mounting bracket, a drive shaft arranged to be mounted to the mounting bracket and further arranged for coupling to a drive unit, the drum winch further including:

a drum on which rode can be wound, the drum being mounted on the drive shaft;

means for moving the drum along the drive shaft from a first position to a second position, said moving means including a lever and an actuator, the lever having a first end arranged to be fixed to a mounting bracket of the drum winch or another support means and a second end arranged to cantilever about said first end when pressed against by said actuator so that a part of the lever moves the drum from the first position to the second position;

the drum arranged so that in the first position, rotation of the drive shaft is directly transmitted to the drum, and in the second position, the drum is free to rotate relative to the drive shaft.

2. A drum winch according to claim 1 further including coupling means arranged so that in the first position the coupling means couples the drum directly to the drive shaft so that rotational movement of the drive shaft is directly transmitted to the drum thereby causing rotational movement of the drum.

3. A drum winch according to claim 2 wherein the coupling means includes a socket and a complementary engagement means arranged to be received in said socket.

4. A drum winch according to claim 3 wherein the socket is located on a boss formed on the drum and the engagement means is located on the drive shaft.

5. A drum winch according to claim 4 wherein the engagement means is formed as a section of the drive shaft.

6. A drum winch according to claim 5 wherein the section of the drive shaft includes one or more flat faces arranged to engage with one or more surfaces of the socket.

7. A drum winch according to claim 1 further including a return means arranged to return the drum from the second position to the first position.

8. A drum winch according to claim 7 wherein the return means is a spring.

9. A drum winch according to claim 8 wherein the spring is mounted about the drive shaft and is located between a portion of the mounting bracket and the drum.

10. A drum winch according to claim 1 further including means for braking rotation of the drum to prevent overrun of the drum when it is in the second position.

11. A drum winch according to claim 1 wherein operation of the moving means to move the drum from the first position to the second position is independent of rotation of the drive shaft.

12. A free fall adaptor assembly for a drum winch, the assembly including a drive shaft for mounting a drum thereon, an actuator arranged to move the drum from a first position on the drive shaft in which the drum is rotated by direct drive of the drive shaft to a second position on the drive shaft wherein the drum is free to rotate relative to the drive shaft and a return means for returning the drum to the first position, the adaptor assembly further including a lever, said lever having a first end arranged to be fixed to a mounting bracket of the drum winch or another support means and a second end arranged to cantilever about said first end when pressed against by said actuator so as to move the drum from the first position to the second position.

13. A free fall adaptor assembly according to claim 12 wherein the return means is a spring.

14. A drum winch including a mounting bracket, a drive shaft arranged to be mounted to the mounting bracket and further arranged for coupling to a drive unit, the drum winch further including:

a drum on which rode can be wound, the drum being mounted on the drive shaft;

means for moving the drum along the drive shaft from a first position to a second position;

coupling means including a socket located in a boss formed on the drum and an engagement section on the drive shaft, arranged so that in the first position, the coupling means couples the drum directly to the drive shaft so that rotational movement of the drive shaft is directly transmitted to the drum thereby causing rotational movement of the drum, and in the second position, the drum is free to rotate relative to the drive shaft.

15. A drum winch according to claim 14 wherein the moving means includes a translation plate and an actuator, the actuator being operable to move the translation plate which in turn causes movement of the drum along the drive shaft.

16. A drum winch according to claim 15 wherein the translation plate has a first end that is fixed to the mounting bracket or another support means and a second end that is movable whereby force applied by the actuator to the translation plate causes the second end to move so that a part of the translation plate moves the drum to the second position.

17. A drum winch according to claim 14 wherein the engagement section of the drive shaft includes one or more flat faces arranged to engage with one or more surfaces of the socket.

18. A drum winch according to claim 14 further including a return means arranged to return the drum from the second position to the first position.

19. A drum winch according to claim 18 wherein the return means is a spring.

20. A drum winch according to claim 14 wherein operation of the moving means to move the drum along the drive shaft is independent of the state of rotation of the drive shaft.

* * * * *